US007183032B2

(12) United States Patent
Hidaka et al.

(10) Patent No.: US 7,183,032 B2
(45) Date of Patent: Feb. 27, 2007

(54) TONER FOR ELECTROSTATIC IMAGE DEVELOPMENT

(75) Inventors: Yasuhiro Hidaka, Wakayama (JP); Hisakazu Tajima, Wakayama (JP)

(73) Assignee: Kao Corporation, Tokyo (JP)

( * ) Notice: Subject to any disclaimer, the term of this patent is extended or adjusted under 35 U.S.C. 154(b) by 265 days.

(21) Appl. No.: 10/849,853

(22) Filed: May 21, 2004

(65) Prior Publication Data

US 2004/0241564 A1 Dec. 2, 2004

(30) Foreign Application Priority Data

May 30, 2003 (JP) ..... 2003-155919
Oct. 14, 2003 (JP) ..... 2003-353948

(51) Int. Cl.
*G03G 9/00* (2006.01)

(52) U.S. Cl. ..... 430/108.4; 430/108.8; 430/109.4

(58) Field of Classification Search ..... 430/108.4, 430/108.8, 109.4
See application file for complete search history.

(56) References Cited

U.S. PATENT DOCUMENTS 4,656,111 A * 4/1987 Wakamiya et al. ..... 430/110.2
5,614,347 A 3/1997 Aoki et al.
5,840,456 A 11/1998 Tomita et al.
6,168,894 B1 1/2001 Aoki et al.
2001/0003634 A1 6/2001 Ohmura et al.
2002/0022190 A1 2/2002 Iizuka et al.

OTHER PUBLICATIONS

The Condensed Chemical Dictionary, Eighth Edition, Gessner G. Hawley, Reinhold Publishing, 1971, p. 173.*
U.S. Appl. No. 11/199,250, filed Aug. 9, 2005, Hidaka.
Derwent Publications, AN 2001-552327, XP-002290187, JP 2001-109188, Apr. 20, 2001.
Derwent Publications, AN 2002-262345, XP-002290188, JP 2001-305795, Nov. 2, 2001.
Patent Abstracts of Japan, JP 11-002917, Jan. 5, 1999.
Patent Abstracts of Japan, JP 2000-131889, May 12, 2000.
Patent Abstracts of Japan, JP 06-266156, Sep. 22, 1994.
U.S. Appl. No. 11/423,792, filed Jun. 13, 2006, Eida et al.

* cited by examiner

*Primary Examiner*—Mark A. Chapman
(74) *Attorney, Agent, or Firm*—Oblon, Spivak, McClelland, Maier & Neustadt, P.C.

(57) ABSTRACT

A toner for electrostatic image development, containing a resin binder containing a polyester, a colorant, and a releasing agent containing an ester wax and a petroleum wax; and a process for preparing a toner for electrostatic image development, including the step of melt-kneading raw materials for the above toner, wherein the melt-kneading step is carried out with an open-roller type kneader. The toner for electrostatic image development is used for the development of a latent image formed in electrophotography, electrostatic recording method, electrostatic printing method or the like.

20 Claims, No Drawings

TONER FOR ELECTROSTATIC IMAGE DEVELOPMENT

FIELD OF THE INVENTION

The present invention relates to a toner for electrostatic image development which is, for instance, used for the development of a latent image formed in electrophotography, electrostatic recording method, electrostatic printing method or the like, and a process for preparing the toner.

BACKGROUND OF THE INVENTION

With the trends of lowering electric power and miniaturization of full-color printers, demands for higher speeds and higher durability have been increasing at the same time as demands for oil-less fusing of a full-color toner. Therefore, technical problems involved with the demands have been studied from the various viewpoints.

From the viewpoint of oil-less fusing of a full-color toner, appropriate selections of waxes to be contained in the toner according to the problems have been tried.

Japanese Patent Laid-Open No. Hei 11-2917 discloses that a toner containing a vegetable-based wax and a synthetic hydrocarbon-based wax is effective for the realization of a low-temperature fixing ability adaptable for high-speed fixing, prevention of the offset phenomenon and the like.

Japanese Patent Laid-Open No. 2000-131889 discloses a technique of a toner containing a specified organometallic compound for the purpose of giving the toner the triboelectric properties which are stable against fluctuations in humidity environment, and further containing two different kinds of specified waxes for the purpose of further enhancing the effects of the organometallic compound.

Japanese Patent Laid-Open No. Hei 6-266156 discloses a technique of a combined use of carnauba wax and a low-molecular weight polypropylene as releasing agents for a specified polyester for the purposes of securing offset resistance and low-temperature fixing temperature during fixing in a non-contact development.

SUMMARY OF THE INVENTION

The present invention relates to:

(1) a toner for electrostatic image development, containing:
- a resin binder containing a polyester;
- a colorant; and
- a releasing agent containing an ester wax and a petroleum wax;

(2) a process for preparing a toner for electrostatic image development, including the step of melt-kneading raw materials for the toner according to the above (1), wherein the melt-kneading step is carried out with an open-roller type kneader; and (3) a process for jumping development of a toner, including the step of applying the toner of the above (1) to a developing device for a non-contact type development.

DETAILED DESCRIPTION OF THE INVENTION

The present invention relates to a toner for electrostatic image development, which contains a combination of specified waxes for a polyester contained as a resin binder, wherein the toner is excellent in fixing ability and durability, as well as jumping property especially in, for instance, a process for jumping development; and a process for preparing the toner.

These and other advantages of the present invention will be apparent from the following description.

From the viewpoint of meeting the requirements in a full color toner for oil-less fusing and higher speeds, sufficient fixing ability cannot be obtained in the above-mentioned conventional techniques, so that a further improvement in fixing ability is required. In other words, the improvement in fixing ability is likely to accompany the lowering of durability. From the viewpoint of satisfying the properties which are conflicting to each other, studies on a selection of a releasing agent such as a wax for a toner containing a resin binder containing a polyester have not yet been made.

Conventionally, for the purpose of improving fixing ability of a toner containing a resin binder containing a polyester, an ester wax has been selected because of its excellent dispersibility in the polyester and excellent durability. However, since the ester wax has exceedingly excellent dispersibility with the polyester, the ester wax may be over-dispersed in the polyester in some cases, so that the wax is less exposed to the surface during fixing. For these reasons, it may be difficult to keep fixing ability at a high level in some cases.

On the other hand, a wax which is hardly dispersible in polyester, such as a synthetic hydrocarbon-based wax or a petroleum wax, has a too large dispersion particle size in a toner, so that a significant effect in fixing ability is obtained. However, this wax has poor stability of durability printing, thereby making it very difficult to be used in a toner containing a resin binder containing a polyester. A low-molecular weight polypropylene wax has a high melting point, as compared to that of a petroleum wax and a synthetic hydrocarbon-based wax, so that its dispersibility in the polyester is improved, but its effect for fixing ability is insufficient because of the high melting point.

The present inventors have made various studies in order to obtain a toner having high fixing ability while maintaining high durability ascribed to the ester wax against the polyester. As a result, the present inventors have found that the above-mentioned conflicting properties can be both satisfied at high levels only by the use of a specified combination of different kinds of waxes.

Durability and fixing ability of a toner are properties conflicting to each other, and greatly influenced by dispersibility of a wax. In other words, when dispersibility of the wax is too excellent, durability is improved but fixing ability is worsened. On the other hand, when dispersibility is poor, fixing ability is improved but durability is worsened. Therefore, in general, even when a wax having excellent dispersibility and a wax having poor dispersibility are mixed, the defects of both properties are not compensated, so that durability and fixing ability cannot be both satisfied.

For instance, in a case where carnauba wax of which dispersibility in the polyester is very excellent and a synthetic hydrocarbon-based wax of which dispersibility is poor are mixed, the excellent durability accomplished by the carnauba wax is impaired, and only the properties of the synthetic hydrocarbon-based wax are exhibited.

However, the present inventors have clarified that fixing ability and durability are satisfied at high levels specifically in the case of a combined use of an ester wax and a petroleum wax.

Further, the present inventors have clarified that the toner of the present invention exhibits an excellent effect in a process for jumping development. Here, the process for jumping development is a non-contact type development including the steps of feeding a toner to a toner supporting member, forming a thin layer of the toner on the toner supporting member by a regulating member and charging the toner, developing an electrostatic image in a non-contact state on a photoconductor keeping an electrostatic image, and transferring the electrostatic image to a sheet.

In other words, in the oil-less fusing, it is necessary to increase an amount of a wax in a toner in order to secure fixing ability. However, in the process for jumping development, an external additive is embedded in the toner surface during durability printing, so that the jumping property may be lowered in some cases.

However, the preferred toner of the present invention exhibits an excellent effect of preventing the jumping property from being lowered in the process for jumping development with an appropriate amount of wax without impairing fixing ability.

The ester wax used in the present invention refers to a wax having an ester group. The ester wax may be any of synthetic ester waxes and natural ester waxes. Among them, it is preferable that the ester wax is one or more members selected from natural ester waxes such as carnauba wax, montan wax, candelilla wax and rice wax from the viewpoint of dispersibility.

The petroleum wax refers to a paraffin wax, microcrystalline wax and petrolatum according to JIS K 2235. In the present invention, it is preferable to select one or more waxes selected from the above-mentioned petroleum waxes.

The combination of the ester wax with the petroleum wax in the present invention is preferably a combination of one or more selected from rice wax and carnauba wax, with one or more selected from a microcrystalline wax and a paraffin wax, even more preferably a combination of carnauba wax with a paraffin wax, from the viewpoint of satisfying both fixing ability and durability.

It is preferable that the smaller the difference in melting point between the ester wax and the petroleum wax, the better, from the viewpoint of compatibility in the present invention, contrary to conventional techniques such as Japanese Patent Laid-Open No. 2000-131889, and the like, describing that the larger the difference in melting point, the better. Specifically, the difference in melting point is preferably 20° C. or less, more preferably 15° C. or less, even more preferably 10° C. or less, even more preferably 5° C. or less. By increasing the compatibility between the waxes, fixing ability and durability are likely to be improved.

The melting point of the petroleum wax is preferably 70° C. or higher from the viewpoint of blocking resistance and preferably 95° C. or lower from the viewpoint of fixing ability. Also, it is preferable that the melting point of the petroleum wax is lower than that of the ester wax from the viewpoint of dispersibility, and that the melting point of the ester wax is 70° C. or higher and 100° C. or lower.

The weight ratio of the ester wax to the petroleum wax (ester wax/petroleum wax) is preferably from 1/9 to 9/1, more preferably from 3/7 to 8/2, from the viewpoint of dispersibility. Further, taking the jumping property into consideration, the weight ratio is preferably from 3/7 to 7/3, more preferably from 4/6 to 7/3, even more preferably from 5/5 to 7/3, and even more preferably, from the viewpoint of dispersibility, from 6/4 to 7/3.

The content of the ester wax is preferably from 0.5 to 10 parts by weight, more preferably from 1 to 8 parts by weight, even more preferably from 2 to 5 parts by weight, based on 100 parts by weight of the resin binder, from the viewpoints of fixing ability ant durability.

The content of the petroleum wax is preferably from 0.5 to 10 parts by weight, more preferably from 1 to 8 parts by weight, even more preferably from 1 to 5 parts by weight, based on 100 parts by weight of the resin binder, from the viewpoints of fixing ability and durability.

The toner of the present invention may appropriately contain a releasing agent other than the ester wax and the petroleum wax, within the range which would not impair the effects of the present invention. The total amount of the ester wax and the petroleum wax in the releasing agent is preferably 50% by weight or more, more preferably 70% by weight or more, even more preferably 90% by weight or more, even more preferably 100% by weight, from the viewpoints of durability and jumping property.

The content of the polyester used as a resin binder in the toner of the present invention is preferably from 50 to 100% by weight, more preferably from 80 to 100% by weight, even more preferably 100% by weight, of the resin binder. A resin other than the polyester which may be contained in the resin binder includes a styrene-acrylic resin, an epoxy resin, a polycarbonate, a polyurethane and the like.

The polyester is obtained by polycondensation of raw material monomers including an alcohol component containing a dihydric or higher polyhydric alcohol and a carboxylic acid component containing a dicarboxylic or higher polycarboxylic acid compound.

The dihydric alcohol includes an alkylene (2 or 3 carbon atoms) oxide (average number of moles: 1 to 10) adduct of bisphenol A, such as polyoxypropylene(2.2)-2,2-bis(4-hydroxyphenyl)propane and polyoxyethylene(2.0)-2,2-bis(4-hydroxyphenyl)propane, ethylene glycol, propylene glycol, 1,6-hexanediol, bisphenol A, hydrogenated bisphenol A, and the like.

The trihydric or higher polyhydric alcohol includes sorbitol, 1,4-sorbitan, pentaerythritol, glycerol, trimethylolpropane, and the like.

Also, the dicarboxylic acid compound includes dicarboxylic acids such as phthalic acid, isophthalic acid, terephthalic acid, fumaric acid and maleic acid; a substituted succinic acid of which substituent is an alkyl group having 1 to 20 carbon atoms or an alkenyl group having 2 to 20 carbon atoms; acid anhydrides thereof; alkyl (1 to 12 carbon atoms) esters thereof, and the like.

The tricarboxylic or higher polycarboxylic acid compound includes 1,2,4-benzenetricarboxylic acid (trimellitic acid), acid anhydrides thereof, alkyl(1 to 12 carbon atoms) esters thereof, and the like.

Incidentally, the alcohol component and the carboxylic acid component may appropriately include a monohydric alcohol and a monocarboxylic acid compound, respectively, from the viewpoints of adjustment of molecular weight and improvement in offset resistance.

The polyester can be prepared by, for instance, polycondensation of the alcohol component with the carboxylic acid component in an inert gas atmosphere at a temperature of 180° to 250° C. under reduced pressure using an esterification catalyst as desired.

In the present invention, the polyester is preferably an amorphous polyester from the viewpoint of durability. In the present invention, the amorphous polyester refers to a polyester having a ratio of the softening point to the maximum peak temperature of heat of fusion (softening point/maximum peak temperature of heat of fusion) of more than 1.3 and 4.0 or less, preferably from 1.5 to 3.

In the case where the polyester is the amorphous polyester, the softening point is preferably from 80° to 160° C., and the glass transition temperature is preferably from 50° to 85° C. from the viewpoints of storage property and fixing ability.

The acid value of the polyester is preferably from 0.5 to 60 mg KOH/g, and the hydroxyl value is preferably from 1 to 60 mg KOH/g, from the viewpoints of dispersibility of the colorant and transferability. In the case of a positively chargeable toner, the acid value of the polyester is preferably 5 mg KOH/g or less, more preferably from 0.5 to 5 mg KOH/g, from the viewpoint of securing an even higher durability.

The weight ratio of the polyester to a total amount of the ester wax and the petroleum wax in the toner is preferably from 1/9 to 9/1, more preferably from 2/8 to 8/2, even more preferably from 3/7 to 7/3, from the viewpoint of compatibility.

As the colorant used in the present invention, all of the dyes, pigments and the like which are used as colorants for toners can be used, and the colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, and the like. These colorants can be used alone or in admixture of two or more kinds. The toner of the present invention may be any of black toner, monocolor toner and full-color toner. The amount of the colorant formulated is preferably from 1 to 40 parts by weight, more preferably from 3 to 10 parts by weight, based on 100 parts by weight of the resin binder.

It is preferable that the toner of the present invention further contains a charge control agent. Specifically, it is preferable that the toner contains a copolymer having a quaternary ammonium salt group as a charge control agent. The copolymer having a quaternary ammonium salt group serves as a charge control resin giving a positive chargeability to the toner, so that an excellent positive chargeability can be secured even in the positively chargeable toner containing a polyester having negative chargeability.

Especially, the combination of the waxes in the present invention is highly excellent in compatibility with the copolymer having a quaternary ammonium salt group, so that the dispersion of the copolymer having a quaternary ammonium salt group is accelerated in the toner, thereby securing more stable chargeability. Consequently, since the initial rise in the triboelectric charge is improved so that the required triboelectric charges are obtained with less friction, the toner scattering is less likely to be worsened during durability printing.

Further, since the toner of the present invention containing a charge control agent containing the above-described copolymer having a quaternary ammonium salt group exhibits high durability and stable positive chargeability against a positively charged photoconductor, the toner is favorably used for a positively charged photoconductor which produces less ozone and are eco-friendly, especially for an amorphous silicon-based positively charged photoconductor having a longer life.

The copolymer having a quaternary ammonium salt group is preferably a compound obtained by a process including the step of polymerizing a monomer mixture containing a monomer represented by the formula (I):

(I)

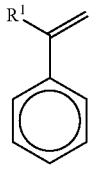

wherein $R^1$ is a hydrogen atom or a methyl group;

a monomer represented by the formula (II):

(II)

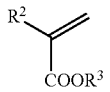

wherein $R^2$ is a hydrogen atom or a methyl group; and $R^3$ is an alkyl group having 1 to 6 carbon atoms; and a monomer represented by the formula (III):

(III)

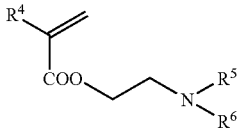

wherein $R^4$ is a hydrogen atom or a methyl group; and $R^5$ and $R^6$ are an alkyl group having 1 to 4 carbon atoms, or a quatemarized compound thereof, preferably a monomer represented by the formula (III).

It is desired that the monomer represented by the formula (I) is styrene in which $R^1$ is a hydrogen atom, that the monomer represented by the formula (II) is a monomer in which $R^2$ is a hydrogen atom and $R^3$ is an alkyl group having 1 to 4 carbon atoms, preferably butyl acrylate in which $R^2$ is a hydrogen atom and $R^3$ is a butyl group, and that the monomer represented by the formula (III) is a monomer in which $R^4$ is a methyl group and $R^5$ and $R^6$ are a methyl group or an ethyl group, preferably dimethylaminoethyl methacrylate in which $R^4$, $R^5$ and $R^6$ are methyl groups.

It is desired that the content of the monomer represented by the formula (I) is from 60 to 97% by weight, preferably from 70 to 90% by weight, of the monomer mixture, that the content of the monomer represented by the formula (II) is from 1 to 33% by weight, preferably from 5 to 20% by weight, of the monomer mixture, and that the content of the monomer represented by the formula (III) or a quatemarized compound thereof is from 2 to 35% by weight, preferably from 5 to 20% by weight, of the monomer mixture.

The polymerization of the monomer mixture can be carried out, for instance, by heating the monomer mixture to 50° to 100° C. in the presence of a polymerization initiator such as azobisdimethylvaleronitrile under an inert gas atmosphere. Incidentally, the polymerization method may be any of solution polymerization, suspension polymerization and bulk polymerization, and preferably solution polymerization.

The solvent includes organic solvents such as toluene, xylene, dioxane, ethylene glycol monomethyl ether, ethyl acetate and methyl ethyl ketone; and mixtures of these organic solvents with a lower alcohol such as methanol, ethanol, propanol or isopropanol.

Incidentally, in the present invention, when the monomer represented by the formula (III) is used, the copolymer obtained as described above can be further quaternarized with a quaternarization agent, to give the above-described copolymer having a quaternary ammonium salt group. The quaternarization agent includes methyl p-toluenesulfonate, dimethyl sulfate, methyl hydroxynaphthalenesulfonate, methyl chloride, methyl iodide, benzyl chloride and the like. Among them, methyl p-toluenesulfonate is preferable because stable and high triboelectric chargeability is obtained. The amount of the quatemarization agent used is preferably from 0.8 to 1.0 mol per 1 mol of the monomer represented by the formula (III). The quaternarization of the copolymer described above can be carried out, for instance, by heating the copolymer and the quaternarization agent to a temperature of from 60° to 90° C. in the solvent.

Also, when the quaternarized compound of the monomer represented by the formula (III) is used, those obtained by quaternarization of the monomer represented by the formula (III) using the same quaternarization agent as above can be used. Alternatively, a quaternary ammonium halide obtained by treatment with an alkyl halide such as methyl chloride can be used as the quaternarized compound of the monomer represented by the formula (III), and the copolymer obtained using the quaternary ammonium halide is treated with an acid such as p-toluenesulfonic acid or hydroxynaphthalene-sulfonic acid to perform counter ion exchange, to give the desired copolymer having a quaternary ammonium salt group.

The weight-average molecular weight of the thus obtained copolymer having a quaternary ammonium salt group is preferably from 5000 or more from the viewpoint of storage stability, and the weight-average molecular weight is preferably 100000 or less, from the viewpoint of compatibility with the resin, more preferably from 10000 to 50000.

The content of the charge control agent is preferably from 0.5 to 40 parts by weight, more preferably from 1 to 30 parts by weight, even more preferably from 5 to 25 parts by weight, based on 100 parts by weight of the resin binder, in order to obtain an appropriate level of triboelectric charges.

The toner of the present invention may appropriately contain a charge control agent other than the copolymer having a quaternary ammonium salt group.

In the toner of the present invention, additives such as fluidity improvers, electric conductivity modifiers, extenders, reinforcing fillers such as fibrous substances, antioxidants, anti-aging agents, and cleanability improvers may be appropriately added internally or externally.

The process for preparing a toner of the present invention may be any of conventionally known methods such as kneading and pulverization method, emulsification and phase-inversion method, and polymerization method. The kneading and pulverization method including the step of melt-kneading the raw materials is preferable because the preparation of the toner is easy.

In the melt-kneading of the raw materials, a closed kneader, a closed, single-screw or twin-screw extruder, or the like is used. In the present invention, it is preferable that the toner is prepared via the melt-kneading step using an open-roller type kneader, from the viewpoint of obtaining satisfactory performance of both fixing ability and durability at high levels. By this step, since the petroleum wax, which is difficult to be dispersed in the other knead-melting process, can be excellently dispersed without impairing fixing ability of the ester wax, durability of the toner can be even further improved.

The raw material to be fed to the open-roller type kneader is preferably a pre-mixture of the resin binder, a colorant, the ester wax, the petroleum wax, the charge control agent and the like, previously mixed with a Henschel mixer or the like.

The open-roller type kneader in the present invention refers to a kneader including at least two rollers, and an open-type melt-kneading member. Preferably used is a kneader including two rollers, one of which is a heat roller and the other is a cooling roller. In the open-roller type kneader described above, the heat generated during melt-kneading can be readily dissipated. In addition, the open-roller type kneader is preferably a continuous-type from the viewpoint of production efficiency.

Further, in the above-described open-roller type kneader, the two rollers are arranged in parallel and close to each other. The gap between the rollers is preferably from 0.01 to 5 mm, more preferably from 0.05 to 2 mm. In addition, the structure, size, material and the like of the roller are not particularly limited, and the roller surface may be any of smooth, wavy, rugged and other form.

The rotational speed, i.e. a circumferential speed, is preferably from 2 to 100 m/min. The circumferential speed of the cooling roller is preferably from 2 to 100 m/min, more preferably from 10 to 60 m/min, even more preferably from 15 to 50 m/min. In addition, it is preferable that the two rollers have different circumferential speeds from each other, and the ratio of the circumferential speeds of the two rollers (cooling roller/heat roller) is preferably from 1/10 to 9/10, more preferably from 3/10 to 8/10.

In order that the kneaded mixture is easily adhered to the heat roller, it is preferable that the temperature of the heat roller is controlled so as to be higher than those temperatures of any of the softening point of the resin binder and the melting points of the waxes, and that the temperature of the cooling roller is controlled so as to be lower than those temperatures of any of the softening point of the resin binder and the melting points of the waxes. Specifically, the temperature of the heat roller is preferably from 80° to 200° C., and the temperature of the cooling roller is preferably from 20° to 140° C.

The difference in temperature between the heat roller and the cooling roller is preferably from 60° to 150° C., more preferably from 80° to 120° C.

Incidentally, the temperature of the rollers can be controlled, for instance, by the temperature of the heat transfer medium passing through the inner part of the rollers. The inner part of each roller is divided into two or more sections, and different heat transfer media of different temperatures may be passed through the respective sections.

The temperature of the heat roller, especially at the side of feeding raw materials, is preferably higher than any of the softening point of the resin binder and the melting points of each of the waxes, more preferably higher than the highest temperature of these temperatures by 0° to 80° C., even more preferably higher by 5° to 50° C. Also, the temperature of the cooling roller is preferably lower than any of the softening point of the resin binder and the melting points of the waxes, more preferably lower than the lowest temperature of these temperatures by 0° to 80° C., even more preferably lower by 40° to 80° C.

Next, the resulting kneaded mixture is cooled until the hardness of the product is to a pulverizable degree, pulverized and, as occasion demands, classified, whereby a toner can be obtained. The volume-average particle size ($D_{50}$) of the toner obtained according to the present invention is preferably from 3 to 15 μm. Further, a fluidity improver such as hydrophobic silica may be externally added to the surface of the roughly pulverized product obtained during the preparation stage of the toner or the surface of the toner.

Incidentally, the effects of the present invention described above can be exhibited by the interaction between the polyester as a resin binder and the two kinds of releasing agents, i.e. the ester wax and the petroleum wax. Therefore, it is preferable that the waxes are uniformly dispersed in the toner rather than being concentrated in the core material or the center part of the toner as in an encapsulated toner.

The toner of the present invention can be used alone as a developer, in a case where the fine magnetic material powder is contained. Alternatively, the toner can be used as a nonmagnetic one-component developer, or the toner can be mixed with a carrier as a two-component developer, in a case where the fine magnetic material powder is not contained. The toner of the present invention can be used for any type of development without particular limitation.

EXAMPLES

[Maximum Peak Temperature of Heat of Fusion and Glass Transition Temperature of Resin, and Melting Point of Wax]

The maximum peak temperature of heat of fusion is determined using a differential scanning calorimeter (commercially available from Seiko Instruments, Inc., DSC Model 210), by raising its temperature to 200° C., cooling the hot sample from this temperature to 0° C. at a cooling rate of 10° C./min., and thereafter heating the sample so as to raise the temperature at a rate of 10° C./min. Incidentally, the maximum peak temperature of heat of fusion corresponds to the melting point in a wax. In addition, the glass transition temperature refers to the temperature of an intersection of the extension of the baseline of equal to or lower than the maximum peak temperature and the tangential line showing the maximum inclination between the kick-off of the peak and the top of the peak by the determination mentioned above for an amorphous resin.

[Acid Value and Hydroxyl Value of Resin]

The acid value and the hydroxyl value of a resin are measured by a method according to JIS K 0070.

[Volume-Average Particle Size ($D_{50}$) of Toner]

Measuring Apparatus: Coulter Multisizer II (commercially available from Beckman Coulter)

Aperture Diameter: 100 μm

Range of Determined Particle Size: 2 to 60 μm

Analyzing Software: Coulter Multisizer AccuComp Ver. 1.19 (commercially available from Beckman Coulter)

Electrolyte: Isotone II (commercially available from Beckman Coulter)

Dispersion: 5% electrolyte of EMULGEN 109P (commercially available from Kao Corporation, polyoxyethylene lauryl ether, HLB: 13.6)

Dispersing Conditions: Ten milligrams of a test sample is added to 5 ml of a dispersion, and the resulting mixture is dispersed in an ultrasonic disperser for 1 minute. Thereafter, 25 ml of an electrolyte is added to the dispersion, and the resulting mixture is dispersed in an ultrasonic dispersing apparatus for another 1 minute.

Measurement Conditions: One-hundred milliliters of an electrolyte and a dispersion are added to a beaker, and the particle sizes of 30000 particles are determined under the conditions for concentration satisfying that the determination for 30000 particles are completed in 20 seconds, to obtain a volume-average particle size ($D_{50}$) from its particle size distribution.

(1) Negatively Chargeable Toner

Resin Preparation Example 1-1

The amount 2450 g of a propylene oxide (average number of mol added: 2.2 mol) adduct of bisphenol A, 980 g of an ethylene oxide (average number of mol added: 2.0 mol) adduct of bisphenol A, 1000 g of terephthalic acid, 320 g of trimellitic acid, 400 g of dodecenylsuccinic acid and 10 g of dibutyltin oxide (esterification catalyst) were agitated under a nitrogen gas stream at 230° C., and reacted until the softening point was attained to about 121° C. as determined according to ASTM D36-86. The resin obtained is referred to as Resin A. Resin A had a maximum peak temperature of heat of fusion of 67° C., a glass transition temperature of 61° C., an acid value of 20.4 mg KOH/g, and a hydroxyl value of 21.6 mg KOH/g.

Example 1-1

Ninety parts by weight of Resin A, 3 parts by weight of a colorant "ECB-301," (commercially available from DAINICHISEIKA COLOR & CHEMICALS MFG. CO., LTD.), 1 part by weight of a charge control agent (metal complex of salicylic acid) "BONTRON E-84" (commercially available from Orient Chemical Co., Ltd.), 3 parts by weight of "Carnauba Wax C1" (commercially available from K. K. Kato Yoko, melting point: 88° C.) and a paraffin wax "HNP-9" (commercially available from NIPPON SEIRO CO., LTD., melting point: 79° C.) were mixed using a Henschel mixer, and thereafter the mixture was melt-kneaded with a twin-screw extruder "PCM-30" (commercially available from IKEGAI Corporation). The kneaded mixture was pulverized and classified using a jet mill and a dispersion separator, to give a powder having a volume-average particle size of 9.0 μm.

To 100 parts by weight of the resulting powder, 1.0 part by weight of a hydrophobic silica "TS-530" (particle size: about 8 nm, commercially available from Cabot Corporation) was adhered onto the powder while mixing in a Henschel mixer, to give a toner.

Example 1-2

The same procedures as in Example 1-1 were carried out except that 3 parts by weight of a synthetic ester wax "NISSAN ELECTOL WEP-6," (commercially available from NOF Corporation, melting point: 80° C.) was used in place of "Carnauba Wax C1", to give a toner having a volume-average particle size of 9.0 μm.

Example 1-3

The same procedures as in Example 1-1 were carried out except that the mixture was melt-kneaded using an open-roller type continuous kneader "Kneadex" (commercially available from MITSUI MINING COMPANY, LIMITED) in place of the twin-screw extruder, the resulting kneaded mixture for toner was cooled on a cooling belt, thereafter the cooled product was roughly pulverized using a mill with a screen having a pore diameter of 2 mm, and the roughly pulverized product was pulverized and classified, to give a toner having a volume-average particle size of 8.9 μm.

The open-roller type continuous kneader used had an outer roller diameter of 0.14 m and an effective roller length of 0.8 m, and operated under the conditions that a rotational speed of a heat roller (front roller) was 33 m/min, a rotational speed of a cooling roller (rear roller) was 22 m/min, and a gap between the rollers was 0.1 mm. In addition, the temperature of the heating medium and the cooling medium in the respective rollers were set, so that the temperature at the raw material feeding side of the heat roller was 150° C., that the temperature at the kneaded mixture discharging side of the heat roller was 130° C., that the temperature at the raw material feeding side of the cooling roller was 35° C., and that the temperature at the kneaded mixture discharging side of the cooling roller was 30° C. The feeding rate for the raw material mixture was 5 kg/hr, and the average residence time was about 5 minutes.

Example 1-4

The same procedures as in Example 1-3 were carried out except that the amount of "Carnauba Wax C1" used was changed to 3.5 parts by weight, and that the amount of the paraffin wax "HNP-9" used was changed to 1.5 parts by weight, to give a toner having a volume-average particle size of 8.9 μm.

Example 1-5

The same procedures as in Example 1-1 were carried out except that the amount of the paraffin wax "HNP-9" was changed to 2 parts by weight and 1 part by weight of a synthetic polyolefin wax "FT-100" (commercially available from NIPPON SEIRO CO., LTD., melting point: 95° C.) was additionally used, to give a toner having a volume-average particle size of 9.0 μm.

Comparative Example 1-1

Eighty-nine parts by weight of Resin A, 3 parts by weight of a colorant "ECB-301," (commercially available from DAINICHISEIKA COLOR & CHEMICALS MFG. CO., LTD.), 1 part by weight of a charge control agent "BONTRON E-84" (commercially available from Orient Chemical Co., Ltd.) and 5 parts by weight of a paraffin wax "HNP-9" (commercially available from NIPPON SEIRO CO., LTD., melting point: 79° C.) were mixed with a Henschel mixer, and thereafter the mixture was melt-kneaded with a twin-screw extruder. The kneaded mixture was pulverized and classified using a jet mill and a dispersion separator, to give a powder having a volume-average particle size of 9.1 μm.

To 100 parts by weight of the resulting powder, 1.0 part by weight of a hydrophobic silica "TS-530" (particle size: about 8 nm, commercially available from Cabot Corporation) was adhered onto the powder while mixing in a Henschel mixer, to give a toner.

Comparative Example 1-2

The same procedures as in Comparative Example 1-1 were carried out except that 5 parts by weight of "Carnauba Wax C1" (commercially available from K.K. Kato Yoko) was used in place of the paraffin wax, to give a toner.

Comparative Example 1-3

The same procedures as in Comparative Example 1-1 were carried out except that 3 parts by weight of "Carnauba Wax C1" (commercially available from K.K. Kato Yoko) and 3 parts by weight of a synthetic polyethylene wax "Polywax 655" (commercially available from Toyo-Petrorite, melting point: 100° C.) were used in place of the paraffin wax, to give a toner.

Comparative Example 1-4

The same procedures as in Comparative Example 1-1 were carried out except that 3 parts by weight of "Carnauba Wax C1" (commercially available from K.K. Kato Yoko) and 3 parts by weight of a synthetic polyolefin wax "FT-100" (commercially available from NIPPON SEIRO CO., LTD., melting point: 95° C.) were used in place of the paraffin wax, to give a toner having a volume-average particle size of 9.0 μm.

Comparative Example 1-5

The same procedures as in Comparative Example 1-1 were carried out except that 3 parts by weight of "Carnauba Wax C1" (commercially available from K.K. Kato Yoko) and 3 parts by weight of a low-molecular weight polypropylene wax "High Wax NP-055" (equivalent to "VISCOL 660P," commercially available from MITSUI CHEMICALS, INC., melting point: 146° C.) were used in place of the paraffin wax, to give a toner having a volume-average particle size of 9.0 μm.

Comparative Example 1-6

The same procedures as in Example 1-1 were carried out except that 90 parts by weight of a styrene-acrylic resin "HIMER SB308" (commercially available from SANYO CHEMICAL INDUSTRIES, LTD., softening point: 131.1° C., glass transition temperature: 57.9° C.) were used in place of Resin A, to give a toner having a volume-average particle size of 9.0 μm.

Comparative Example 1-7

The same procedures as in Comparative Example 1-4 were carried out except that the amount of Resin A was changed to 90 parts by weight, and that the mixture was melt-kneaded with the same open-roller type continuous kneader "Kneadex" (commercially available from MITSUI MINING COMPANY, LIMITED) as that used in Example 1-3 in place of the twin-screw extruder, to give a toner having a volume-average particle size of 9.0 μm.

Test Example 1-1

A toner was loaded on a modified apparatus of "MICROLINE 3010cW" (commercially available from Oki Data Corporation) in which fixing could be carried out outside the apparatus. With setting L paper (commercially available from FUJI XEROX CO., LTD.) in the length direction in the apparatus, a solid image of 2 cm×3 cm was obtained in an unfixed state, while changing the amount of toner adhered. The amount of toner adhered of 1.8 mg/cm$^2$ means that toner forms at least three layers on the paper. The unfixed solid image obtained was fixed with an external fixing device, which was a modified fixing device of "LS-8000C" (commercially available from KYOCERA MITA CORPORATION), and the fixing ability was evaluated according to the following evaluation criteria based on whether the solid image was adhered to the fixing roller used in the fixing, thereby causing the paper to stick around the fixing roller. The results are shown in Table 1.

[Evaluation Criteria]

The fixing ability is evaluated as follows:

◎: no solid image is adhered to the fixing roller even when the toner mass per area is 2.0 mg/cm$^2$ or more;

○: a solid image is adhered to the fixing roller when the toner mass per area is 1.8 mg/cm$^2$ or more and less than 2.0 mg/cm$^2$;

Δ: a solid image is adhered to the fixing roller when the toner mass per area is 1.2 mg/cm$^2$ or more and less than 1.8 mg/cm$^2$; and X: a solid image is adhered to the fixing roller even when the toner mass per area is less than 1.2 mg/cm$^2$.

Test Example 1-2

A toner was loaded in a "MICROLINE 3010cW" (commercially available from Oki Data Corporation), and fixed images at a printing ratio of 5% were continuously printed out for 50000 sheets. The image densities (ID) of images around every 5000 sheet-printing were determined using "Gretag SPM50" (commercially available from Gretag), and the durability was evaluated according to the following evaluation criteria. The results are shown in Table 1.

[Evaluation Criteria]

◎: ID after printing 50000 sheets being 1.2 or more;

○: ID of printing around 30000 sheets being less than 1.2;

Δ: ID of printing around 10000 sheets being less than 1.2; and

X: ID of printing around 5000 sheets being less than 1.2.

Test Example 1-3

A toner was loaded in a copying machine for a process for jumping development "DL-2300" (commercially available from KONICA MINOLTA), and fixed images of 5% chart were continuously printed out for 70000 sheets. The toner on the developing roller was taken with an elastic tape "Mending Tape" (commercially available from Scotch) every 5000 sheets, and pasted on "L paper" (commercially available from XEROX). The image density (ID) was determined using "Gretag SPM50" (commercially available from Gretag), and the jumping property was evaluated according to the following evaluation criteria. The results are shown in Table 1.

[Evaluation Criteria]

◎◎: ID after printing 70000 sheets being 1.2 or more;

◎: ID of printing around 50000 sheets being less than 1.2;

○: ID of printing around 40000 sheets being less than 1.2;

Δ: ID of printing around 30000 sheets being less than 1.2; and

X: ID of printing around 10000 sheets being less than 1.2.

(2) Positively Chargeable Toner

Resin Preparation Example 2-1

The amount 2450 g of a propylene oxide (average number of mol added: 2.2 mol) adduct of bisphenol A, 980 g of an ethylene oxide (average number of mol added: 2.0 mol) adduct of bisphenol A, 1100 g of terephthalic acid, 180 g of trimellitic acid, 380 g of dodecenylsuccinic acid and 10 g of dibutyltin oxide (esterification catalyst) were agitated under a nitrogen gas stream at 230° C., and reacted until the softening point was attained to about 120° C. as determined according to ASTM D36-86. The resin obtained is referred to as Resin B. Resin B had a maximum peak temperature of heat of fusion of 68° C., a glass transition temperature of 61° C., an acid value of 3.0 mg KOH/g, and a hydroxyl value of 36.5 mg KOH/g.

Preparation Example 2-1 for Charge Control Resin

A mixture of 250 g of methanol, 200 g of toluene, 500 g of styrene, 40 g of butyl acrylate, 60 g of dimethylaminoethyl methacrylate and 12 g of azobisdimethylvaleronitrile was polymerized under a nitrogen atmosphere at 70° C. for 10 hours. The resulting reaction solution was cooled, and 150 g of toluene, 100 g of ethanol and 71.0 g of methyl p-toluenesulfonate were added thereto. The resulting mixture was agitated at 70° C. for 5 hours, to carry out quaternalization. The reaction solution was heated to 100° C., and the solvent was distilled off under reduced pressure. Thereafter, the resulting product was pulverized with a jet mill, to give Charge Control Resin A (weight-average molecular weight: 14000).

Example 2-1

The same procedures as in Example 1-3 were carried out using 90 parts by weight of Resin B, 3 parts by weight of a colorant "ECB-301" (commercially available from DAINICHISEIKA COLOR & CHEMICALS MFG. CO., LTD.), 1 part by weight of a charge control agent (trialkylbenzylammonium salt) "BONTRON P-51" (commercially available from Orient Chemical Co., Ltd.), 3 parts by weight of "Carnauba Wax C1" (commercially available from K.K. Kato Yoko, melting point: 88° C.) and 3 parts by weight of a paraffin wax "HNP-9" (commercially available from NIPPON SEIRO CO., LTD., melting point: 79° C.), with an open-roller type continuous kneader (commercially available from MITSUI MINING COMPANY, LIMITED, trade name: Kneadex), to give a toner.

Example 2-2

The same procedures as in Example 2-2 were carried out except that the amount of Resin B used was changed to 85 parts by weight, and that 5 parts by weight of the charge control resin A was additionally used, to give a toner having a volume-average particle size of 9.1 μm.

Example 2-3

The same procedures as in Example 2-1 were carried out except that the amount of "Carnauba Wax C1" used was changed to 3.5 parts by weight, and the amount of the paraffin wax "HNP-9" used was changed to 1.5 parts by weight, to give a toner.

Example 2-4

The same procedures as in Example 2-2 were carried out except that the amount of "Carnauba Wax C1" used was changed to 3.5 parts by weight, and the amount of the paraffin wax "HNP-9" used was changed to 1.5 parts by weight, to give a toner.

Comparative Example 2-1

The same procedures as in Example 2-1 were carried out except that "Carnauba Wax C1" was not used, to give a toner having a volume-average particle size of 9.0 μm.

Test Example 2-1

Five parts by weight of a toner and 95 parts by weight of a silicone resin-coated ferrite carrier having a particle size of 50 μm were mixed with a ball-mill, to give a two-component developer.

The resulting two-component developer was loaded on a modified apparatus of a reversal development apparatus "LS-8000C" (commercially available from KYOCERA MITA CORPORATION), in which modification was made so that fixing was carried out outside the apparatus, the development apparatus containing an amorphous silicon-based positively chargeable photoconductor. With setting L paper (commercially available from FUJI XEROX CO., LTD.) in the length direction to the apparatus, a solid image of 2 cm×3 cm was obtained in an unfixed state, while changing the amount of toner adhered. The amount of toner adhered of 1.8 mg/cm$^2$ means that toner forms at least three layers on the paper. The unfixed solid image was fixed with an external fixing device, which was a modified fixing device of "LS-8000C" (commercially available from KYOCERA MITA CORPORATION). The fixing ability was evaluated according to the following evaluation criteria based on whether the solid image was adhered to the fixing roller used in the fixing, thereby causing the paper to stick around the fixing roller. The results are shown in Table 2.

[Evaluation Criteria]

The fixing ability is evaluated as follows:

◎: no solid image is adhered to the fixing roller even when the toner mass per area is 2.0 mg/cm$^2$ or more;

○: a solid image is adhered to the fixing roller when the toner mass per area is 1.8 mg/cm$^2$ or more and less than 2.0 mg/cm$^2$;

Δ: a solid image is adhered to the fixing roller when the toner mass per area is 1.2 mg/cm$^2$ or more and less than 1.8 mg/cm$^2$; and X: a solid image is adhered to the fixing roller even when the toner mass per area is less than 1.2 mg/cm$^2$.

Test Example 2-2

The two-component developer prepared in Test Example 2-1 was loaded on the apparatus "LS-8000C" (commercially available from KYOCERA MITA CORPORATION), and fixed images at a printing ratio of 5% were continuously printed out for 200000 sheets. The image densities (ID) of images around every 50000 sheet-printing were determined, using "Gretag SPM50" (commercially available from Gretag), and the state of toner scattering was visually observed. The durability and the toner scattering were evaluated according to the following evaluation criteria. The results are shown in Table 2.

[Evaluation Criteria for Durability]

◎: ID after printing 200000 sheets being 1.2 or more;

○: ID of printing around 150000 sheets being less than 1.2;

Δ: ID of printing around 100000 sheets being less than 1.2; and

X: ID of printing around 50000 sheets being less than 1.2.

[Evaluation Criteria for Toner Scattering]

◎: no toner scattering after printing 200000 sheets;

○: toner scattering being generated after printing 150000 sheets;

Δ: toner scattering being generated printing around 50000 sheets; and

X: toner scattering being generated at an earlier stage of the printing.

Test Example 2-3

The same procedures as in Test Example 1-3 were carried out except that "LS-C5016N" (commercially available from KYOCERA MITA CORPORATION) was used as a copying machine for a process for jumping development, and the jumping property was evaluated in the same manner as in Test Example 1-3.

TABLE 1

| [Negatively Chargeable Toner] | | Colorant: ECB-301 | | Charge Control Agent: BONTRON E-84 | | |
|---|---|---|---|---|---|---|
| | | Wax | | | | |
| | Resin Binder | Ester Wax | Melting Point (° C.) | Amount Used (parts by weight) | Petroleum Wax etc. | Melting Point (° C.) |
| Ex. 1-1 | Polyester | Carnauba Wax | 88 | 3 | Paraffin Wax | 79 |
| Ex. 1-2 | Polyester | Synthetic Ester Wax | 80 | 3 | Paraffin Wax | 79 |
| Ex. 1-3 | Polyester | Carnauba wax | 88 | 3 | Paraffin Wax | 79 |
| Ex. 1-4 | Polyester | Carnauba wax | 88 | 3.5 | Paraffin Wax | 79 |
| Ex. 1-5 | Polyester | Carnauba wax | 88 | 3 | Paraffin Wax<br>Polyolefin Wax | 79<br>95 |
| Comp. Ex. 1-1 | Polyester | — | — | — | Paraffin Wax | 79 |
| Comp. Ex. 1-2 | Polyester | Carnauba wax | 88 | 5 | — | — |
| Comp. Ex. 1-3 | Polyester | Carnauba wax | 88 | 5 | Polyethylene Wax | 100 |
| Comp. Ex. 1-4 | Polyester | Carnauba wax | 88 | 3 | Polyolefin Wax | 95 |
| Comp. Ex. 1-5 | Polyester | Carnauba wax | 88 | 3 | Low-Mol. Weight Polypropylene Wax | 146 |
| Comp. Ex. 1-6 | Styrene-Acrylic Resin | Carnauba wax | 88 | 3 | Paraffin Wax | 79 |
| Comp. Ex. 1-7 | Polyester | Carnauba wax | 88 | 3 | Polyolefin Wax | 95 |

TABLE 1-continued

| [Negatively Chargeable Toner] | | | Colorant: ECB-301 | Charge Control Agent: BONTRON E-84 | | |
|---|---|---|---|---|---|---|
| | Wax Amount Used (parts by weight) | Difference in Melting Point (° C.) | Kneader | Fixing Ability | Durability | Jumping Property |
| Ex. 1-1 | 3 | 9 | Twin-Screw Extruder | ○ | ◎ | ○ |
| Ex. 1-2 | 3 | 1 | Twin-Screw Extruder | ○ | ◎ | ○ |
| Ex. 1-3 | 3 | 9 | Open-Roller Type Continuous Kneader | ◎ | ◎ | ◎ |
| Ex. 1-4 | 1.5 | 9 | Open-Roller Type Continuous Kneader | ◎ | ◎ | ◎◎ |
| Ex. 1-5 | 2<br>1 | 9 | Twin-Screw Extruder | ○ | ○ | ○ |
| Comp. Ex. 1-1 | 5 | — | Twin-Screw Extruder | Δ | X | Δ |
| Comp. Ex. 1-2 | — | — | Twin-Screw Extruder | X | Δ | X |
| Comp. Ex. 1-3 | 3 | 12 | Twin-Screw Extruder | X | Δ | X |
| Comp. Ex. 1-4 | 3 | 9 | Twin-Screw Extruder | ○ | X | Δ |
| Comp. Ex. 1-5 | 3 | 58 | Twin-Screw Extruder | X | ○ | Δ |
| Comp. Ex. 1-6 | 3 | 9 | Twin-Screw Extruder | Δ | X | X |
| Comp. Ex. 1-7 | 3 | 9 | Open-Roller Type Continuous Kneader | ○ | X | Δ |

TABLE 2

| [Positively Chargeable Toner] | | | | Resin Binder: Resin B | | Colorant: ECB-301 | |
|---|---|---|---|---|---|---|---|
| | Wax | | | | | | |
| | Ester Wax | Melting Point (° C.) | Amount Used (parts by weight) | Petroleum Wax etc. | Melting Point (° C.) | Amount Used (parts by weight) | Difference in Melting Point (° C.) |
| Ex. 2-1 | Carnauba Wax | 88 | 3 | Paraffin Wax | 79 | 3 | 9 |
| Ex. 2-2 | Carnauba Wax | 88 | 3 | Paraffin Wax | 79 | 3 | 9 |
| Ex. 2-3 | Carnauba Wax | 88 | 3.5 | Paraffin Wax | 79 | 1.5 | 9 |
| Ex. 2-4 | Carnauba Wax | 88 | 3.5 | Paraffin Wax | 79 | 1.5 | 9 |
| Comp. Ex. 2-1 | — | — | — | Paraffin Wax | 79 | 3 | — |

| | Charge Control Agent | Kneader | Fixing Ability | Durability | Toner Scattering | Jumping Property |
|---|---|---|---|---|---|---|
| Ex. 2-1 | BONTRON P-51 | Open-roller Type Continuous Kneader | ○ | ○ | Δ | ○ |
| Ex. 2-2 | BONTRON P-51<br>Charge Control Resin A | Open-roller Type Continuous Kneader | ◎ | ◎ | ◎ | ◎ |
| Ex. 2-3 | BONTRON P-51 | Open-roller Type Continuous Kneader | ○ | ○ | ○ | ◎ |
| Ex. 2-4 | BONTRON P-51<br>Charge Control Resin A | Open-roller Type Continuous Kneader | ◎ | ◎ | ◎ | ◎◎ |
| Comp. Ex. 2-1 | BONTRON P-51 | Open-roller Type Continuous Kneader | Δ | X | Δ | Δ |

It can be seen from the above results that the toners of Examples 1-1 to 1-5 are excellent in fixing ability and durability, which are conflicting properties to each other, as well as the jumping property in the process for jumping development.

On the other hand, the toner of Comparative Example 1-1 which contains only the petroleum wax is poor especially in durability. In the toner of Comparative Example 1-2 which contains carnauba wax but not petroleum wax, and the toners of Comparative Examples 1-3 to 1-5 which contain other waxes in place of petroleum wax, either the fixing ability or the durability is considerably lowered. Also, it can be seen from the toner of Comparative Example 1-6 which contains a styrene-acrylic resin as a resin binder that the durability and the jumping property are markedly lowered, and from Comparative Example 1-7 that even when dispersibility of the wax is increased by using an open-roller type kneader, the fixing ability is merely improved.

In addition, it can be seen that the positively chargeable toners of Examples 2-1 to 2-4 have high durability such that they can be suitably used in an apparatus for reversal development containing an amorphous silicon-based positively chargeable photoconductor. On the other hand, the toner of Comparative Example 2-1 which contains only petroleum wax is poor in durability.

According to the present invention, a toner for electrostatic image development, which is excellent in fixing ability and durability, as well as jumping property in the process for jumping development can be provided. Especially, the toner obtainable according to the present invention has markedly improved durability, so that the toner can be suitably used in an apparatus for reversal development, containing an amorphous silicon-based photoconductor requiring high durability.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for electrostatic image development, comprising:

a resin binder comprising a polyester;

a colorant; and a releasing agent comprising 0.5 to 10 pbw of an ester wax and 0.5 to 10 pbw of a petroleum wax, each based on 100 pbw of said binder resin.

2. The toner according to claim 1, wherein the ester wax is a carnauba wax and the petroleum wax is a paraffin wax.

3. The toner according to claim 1, wherein the difference in melting point between the ester wax and the petroleum wax is within 20° C.

4. The toner according to claim 1, wherein the petroleum wax has a lower melting point than the ester wax.

5. The toner according to claim 1, wherein a weight ratio of the ester wax to the petroleum wax is from 1/9 to 9/1.

6. The toner according to claim 1, wherein a weight ratio of the polyester to a total amount of the ester wax and the petroleum was is 1/9 to 9/1.

7. The toner according to claim 1, wherein the polyester has an acid value of 5 mg KOH/g or less, and wherein the toner further comprises as a charge control agent a copolymer having a quaternary ammonium salt group.

8. The toner according to claim 7, wherein the charge control agent is contained in an amount of from 0.5 to 40 parts by weight, based on 100 parts by weight of the resin binder.

9. The toner according to claim 1, wherein the toner is prepared by a process comprising a melt-kneading step with an open-roller type kneader.

10. A process for preparing a toner for electrostatic image development, comprising the step of melt-kneading raw materials for the toner according to claim 1, wherein the melt-kneading step is carried out with an open-roller type kneader.

11. The toner according to claim 1, wherein said ester wax is at least one selected from the group consisting of carnauba wax, montan wax, candelilla wax and rice wax.

12. The toner according to claim 1, wherein said petroleum wax is at least one selected from the group consisting of paraffin wax, microcrystalline wax and petrolatum.

13. The toner according to claim 1, wherein said ester wax is at least one selected from the group consisting of rice wax and carnauba wax and said petroleum wax is at least one selected from the group consisting of microcrystalline wax and paraffin wax.

14. The toner according to claim 1, wherein said ester wax is carnauba wax and said petroleum wax is paraffin wax.

15. The toner according to claim 1, wherein a content of polyester in said binder resin is 50 to 100 % by weight of said binder resin.

16. The toner according to claim 1, wherein the melting point of said petroleum wax is 70 to 95° C.

17. The toner according to claim 1, wherein the melting point of said ester wax is 70 to 100° C.

18. The toner according to claim 1, wherein said polyester is an amorphous polyester.

19. The toner according to claim 1, wherein said polyester is an amorphous polyester having a softening point from 80 to 160° C.

20. A process for jumping development of a toner, comprising applying a toner comprising:

a resin binder comprising a polyester;

a colorant; and a releasing agent comprising an ester wax and a petroleum wax to a developing device for a non-contact type development;

developing an electrostatic image in a non-contact state on a photoconductor keeping an electrostatic image; and transferring an electrostatic image to a sheet.

* * * * *